United States Patent [19]

Chmielowiec

[11] 4,205,617

[45] Jun. 3, 1980

[54] DOUBLE SEAM TIGHTNESS CONTROL

[75] Inventor: Louis J. Chmielowiec, Lansing, Ill.

[73] Assignee: The Continental Group, Inc., New York, N.Y.

[21] Appl. No.: 954,009

[22] Filed: Oct. 23, 1978

[51] Int. Cl.[2] ..... B21D 51/32

[52] U.S. Cl. ..... 113/19; 29/705; 72/19; 73/141 A

[58] Field of Search ..... 113/7 R, 19, 24 R, 24 A, 113/24 D, 24 E, 24 EA, 24 EB, 24 EC, 24 ED, 24 F, 24 H, 120 K; 73/141 A, 774, 775, 777; 72/19, 20; 338/47; 29/705

[56] References Cited

U.S. PATENT DOCUMENTS

| | | | |
|---|---|---|---|
| 3,222,921 | 12/1965 | Schreiber et al. | 73/52 X |
| 3,620,058 | 11/1971 | Sabatini et al. | 72/19 X |
| 3,832,897 | 9/1974 | Schenck | 73/141 A X |
| 4,022,141 | 5/1977 | Bartenstein | 113/24 A X |

*Primary Examiner*—Carl E. Hall

*Attorney, Agent, or Firm*—Charles E. Brown

[57] ABSTRACT

A tightness control or discriminator for a double seam between an end unit and a container body. The tightness of the double seam is proportional to the force required to form the same in the second forming operation, and this force is reflected in the pressure engagement between the associated cam follower and second operation seaming cam. A load sensor is placed within the seaming cam adjacent the reaction surface thereof for varying of its electrical resistance characteristics in accordance with the seaming force and there are suitable devices provided for indicating, either visually or by way of an alarm, the reaction force which is indicative of tightness.

9 Claims, 4 Drawing Figures

DOUBLE SEAM TIGHTNESS CONTROL

This invention relates in general to apparatus for forming a conventional double seam between a container end unit and a container body, and more particularly to means for indicating the tightness of a formed double seam at the time of forming.

It is known that the tightness of a double seam is indicative of the seal formed thereby. In the past there has been developed double seam testing devices wherein a formed double seam is clamped in a tightness tester and the seam is mechanically deformed with the amount of the deformation being indicative of the tightness of the seam. The patent to Schreiver et al U.S. Pat. No. 3,222,921, granted Dec. 14, 1965 is typical of such double seam testing devices.

In accordance with this invention, it is proposed to provide means for measuring the force required to form a double seam with the force being indicative of the tightness of the double seam. In this manner the tightness of the double seam is automatically determined at the time the double seam is formed.

A conventional double seam is formed in two operations utilizing a first operation seaming tool and a second operation seaming tool with each seaming tool being actuated by a respective cam. Each seaming tool is carried by an elongated shaft which is pivotally journalled and has at the upper end thereof a cam follower which rides over the respective seaming cam so as to move the respective seaming tool toward a combined end unit and container body positioned and backed up by a chuck. The loading of the cam follower on the seaming cam in the second operation is directly indicative of the tightness of the final seam. This is conventional.

In accordance with this invention, it is proposed to provide means for determining the reaction pressure of the cam follower on the second operation seaming cam and to utilize these means specifically to indicate the reaction pressure by means of a selected type of indicator.

Most specifically, in accordance with this invention it is proposed to incorporate within the second operation seaming cam one or more load cells which are in the form of a pressure variable electrical resistor which may be incorporated in a suitable electric circuit for changing the output in accordance with the pressure loading thereon, and this output being directly indicative of the pressure loading.

Further, in accordance with this invention it is proposed to place one or more load cells in the dwell portion of the second operation seaming cam so that the reaction pressure is one which is not indicative of the forming pressure but one which is indicative of the final pressure and thus indicative of the final tightness of the double seam being formed.

It is proposed to provide two load cells which are spaced along the dwell portion of the second operation seaming cam and to provide in the electrical circuit incorporating the load cells a selector whereby a selected one of the load cells may be relied upon to indicate the reaction pressure between the cam follower and the second operation seaming cam.

It is also pointed out here that the customary double seamer is provided with a plurality of seaming stations and thus the electrical circuitry of this invention includes a selector whereby the performance of each station may be individually observed by selecting the output of the load cell at the selected station.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
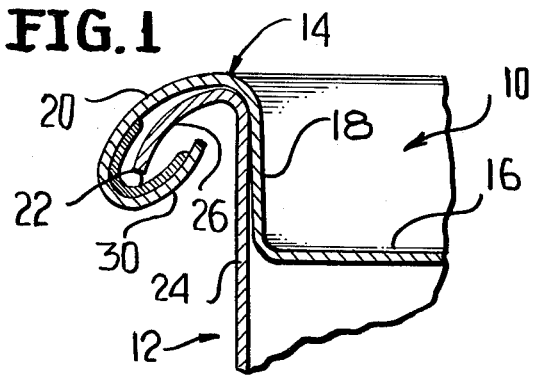
FIG. 1 is a schematic fragmentary sectional view showing the interfolding of a curl portion of an end unit with a flange of a can body after the completion of a conventional first seaming operation.

Referring now to FIG. 1, it will be seen that there is illustrated a conventional end unit 10 in the process of being secured to a conventional can body 12 by way of a conventional double seam, generally indicated by the reference numeral 14 and being only partially formed.

The end unit 10 basically includes an end panel 16 surrounded by an upstanding chuck wall 18 and terminating in a curl 20. The inner surface of the curl 20 is provided with a continuous stripe of sealing compound 22 which is deformable under pressure. The container body 12 includes a body portion 24 which terminates at its end in a flange 26.

Figure 2:
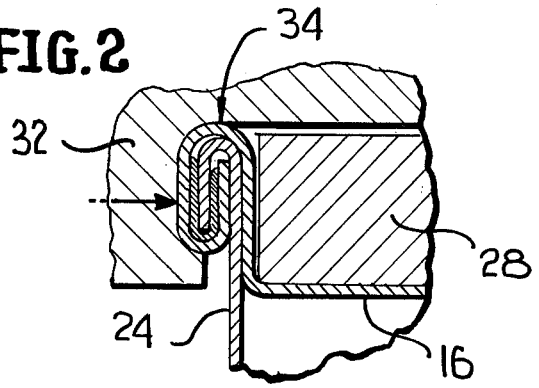
FIG. 2 is a fragmentary schematic sectional view showing the double seam at the completion of the second seaming operation with the second operation tool and the chuck being illustrated in their respective cooperating positions.

In double seaming the end unit 10 to the body 12, the end unit 10 is loosely seated on the body 12 and then is held downwardly by a seaming chuck 28 (FIG. 2) which is of a size tightly to fit within the chuck wall 18. A first operation tool, not shown, serves simultaneously to fold together the curl 20 and the flange 26 to the position generally illustrated in FIG. 1. At this time an end hook portion 30 of the curl 20 is deformed radially inwardly with the result that it has a tendency to become slightly corrugated and it is necessary in the final seam to apply a sufficient forming force to straighten out this terminal portion in order to provide the necessary tight seam.

The second seaming operation is performed utilizing the same seaming chuck 28 in conjunction with a second operation seaming tool 32 of which only a portion is illustrated. The tool 32 is shaped so as to act in cooperation with the chuck 28 not only to complete the interfolding of the curl 20 and the flange 26, but also to apply sufficient radial pressure to the interfolded curl and the flange radially to tighten the same and not only straighten out the end hook portion 30 but also effect a compressing and flowing of the sealing compound 22 on both sides of the terminal portion of the flange 26, thereby to assure a sealed joint between the cam body 12 and the end unit 10.

As stated above, the compactness of the resultant double seam, generally identified by the numeral 34, is determined by the radial tightness thereof. The tightness may be tested by means of a simple tool which deforms the seam radially inwardly, as disclosed in the Schreiber et al U.S. Pat. No. 3,222,921. It has also been found that the tightness of the double seam 34 may be ascertained by determining the reaction force between a cam follower 36 (FIG. 4) utilized for positioning the second operation seaming tool 32 and the second operation seaming cam 38 on which the cam follower 36 rides.

Figure 3:
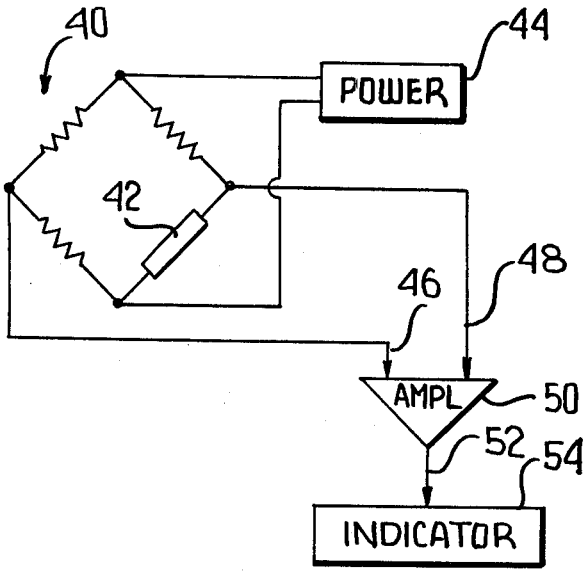
FIG. 3 is a schematic view of an electrical circuit showing the manner in which a pressure variable electrical resistance may be incorporated in an electrical circuit so as to indicate variations in pressure.

There has been developed load sensors or cells in the form of pressure responsive electrical resistors. Referring now to FIG. 3, it will be seen that there is illustrated a conventional Wheatstone bridge 40 which has incorporated in one of the legs thereof a load cell 42 of the pressure responsive variable resistor type. The bridge 40 is provided with a suitable power supply 44 and has the customary output leads 46, 48 which are coupled to an amplifier 50 which has an output 52 connected to an indicator 54. Such a circuit is known from the patent to Schenck U.S. Pat. No. 3,832,897 granted Sept. 3, 1974. Although in the Schenck patent all four resistors of the bridge are load cells or sensors, the output of the bridge may be modified utilizing a single load sensor sufficient to provide the desired indicated pressure when an amplifier is utilized.

Figure 4:
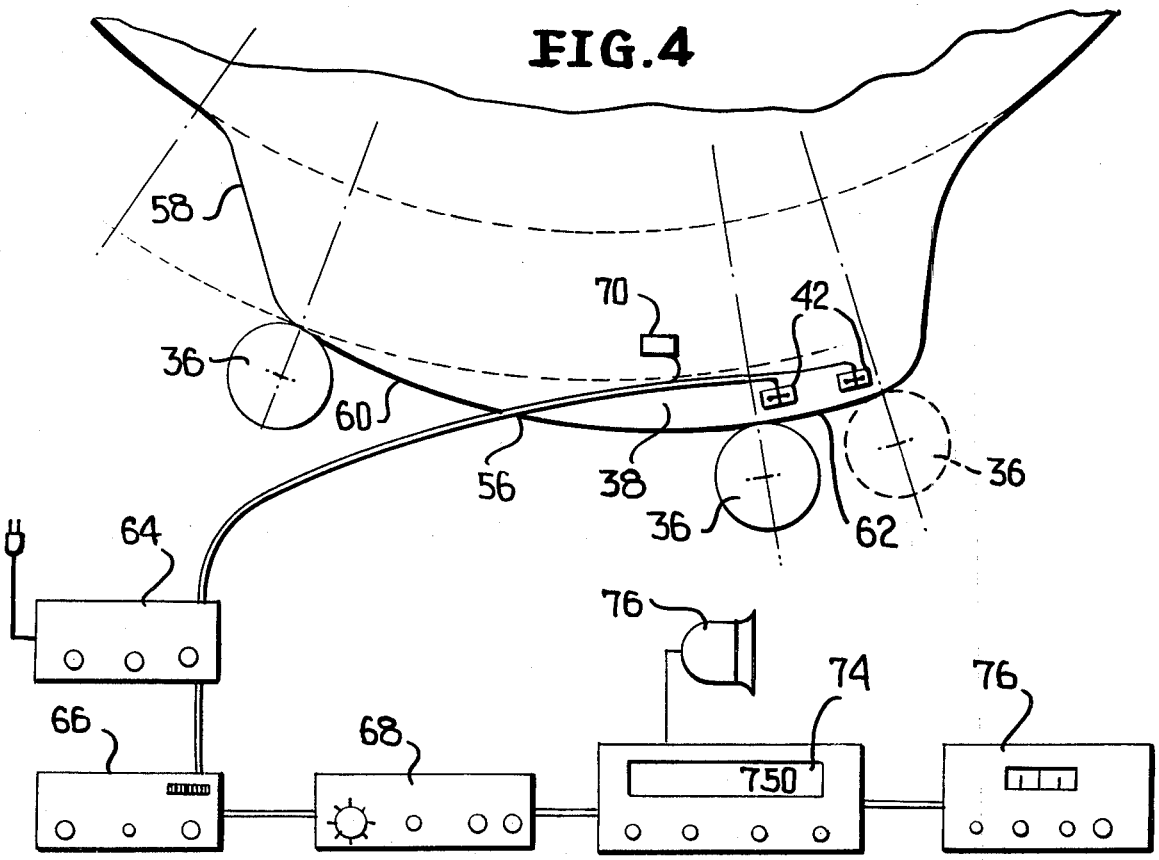
FIG. 4 is a schematic view showing the specific application of the invention to a second operation seaming cam and the indicating and selecting components associated therewith.

Reference is now made to FIG. 4 wherein this invention is specifically illustrated. A typical second operation seaming cam 38 is illustrated and this cam has a reaction surface 56 against which the cam follower 36 rolls during the performing of the second seaming operation. The cam follower 36 rides up a ramp portion 58 of the cam to initiate the second seaming operation and thereafter along a lesser modified ramp portion 60 progressively to increase the tightness of the double seam 34. The terminal portion of the reaction surface 56 is in the form of a dwell portion 62 which is of a constant radius and wherein no further deformation or tightening of the double seam occurs, but wherein the pressure of the second operation seaming tool 32 is maintained with respect to the double seam.

In accordance with this invention one or more of the load sensors or cells 42 is incorporated in the interior of the second operation seaming cam 38 adjacent the reaction surface 56 thereof along the dwell portion 62. In the operation of the double seaming apparatus, the load sensors or cells 42 are compressed in accordance with the force required to form the double seam 34, which force is directly indicative of the tightness of the resultant double seam.

It is to be understood that for each specific can type, which may include a specific base weight or thickness of metal in each of the end unit 10 and the can body 12, the temper of the metal, and compound film weight, a force specification can be established. For example, in the double seam of a conventional beverage can, a force on the order of 700 pounds is required. By monitoring the reaction force between the cam follower and the reaction surface of the second operation seaming cam in the dwell area 62, a visual determination may be made as to the tightness of the double seam as it is formed, thereby eliminating the necessity of double seam tightness testing after seaming of the type disclosed in the Schreiber et al U.S. Pat. No. 3,222,921 which results in the destruction of the tested can.

Use of the two load cells 42 would allow for a discrimination, which would identify the greatest seaming force at the juncture and allow for the reading of a normal maximum seaming force.

Further, it is to be understood that a seaming machine has a plurality of stations and by providing suitable selector means, the force required at any selected station may be readily detected. It is also envisioned that a single detector unit could be utilized in conjunction with a plurality of double seaming machines.

As is shown in FIG. 4, the load cells or sensors 42 are incorporated in a conventional type of electrical circuit which includes a power supply 64 to which a plurality of stations are connected, only two station connections being illustrated for purposes of simplicity.

The power supply 64 may have incorporated therein a Wheatstone bridge arrangement such as that shown in FIG. 3 and is coupled to a conventional amplifier 66. The output of the amplifier 66 is, in turn, coupled to a unit 68 which has the multiple function of seamer station selector, discriminator and temperature compensator. With respect to the temperature compensation, it is to be understood that the seaming apparatus, until it warms up, will have a dimensional variation which can directly influence the forces involved. Further, the load cell or sensor 42 may be affected by temperature changes. Accordingly, there is provided a temperature sensor 70 which is illustrated as being incorporated in the second operation seaming cam but which could otherwise be responsively located in the seaming apparatus. The unit 68 is coupled to a digital read out unit 72 which may have a visual indicator 74 and may also be provided with a suitable alarm 76 which will be actuated when the force required to effect the second seaming operation is either above or below preset standards.

The system may also include a recorder 76 for recording the read out of the digital read out 72.

Although only a preferred embodiment of the invention has been specifically illustrated and described herein, it is to be understood that minor variations may be made in the control mechanism without departing from the spirit and scope of the invention as defined by the appended claims.

I claim:

1. In a double seaming apparatus for securing a can end to a can body in sealed relation by a double seam, said double seaming apparatus including a second operation seaming cam having a face engageable by a cam follower for effecting a second seaming operation wherein a double seam is radially tightened; the improvement being in the form of means for indicating the tightness of a double seam being formed by way of an indication of the pressure load between said second operation seaming cam and said cam follower.

2. The apparatus of claim 1 wherein said means for indicating the tightness of a double seam includes a load sensor within said cam adjacent said face.

3. The apparatus of claim 2 wherein said load sensor is in the form of a pressure variable electrical resistor.

4. The apparatus of claim 2 wherein said load sensor is in the form of a pressure variable electrical resistor, said resistor being coupled in an electrical circuit including an indicator.

5. The apparatus of claim 2 wherein said load sensor is in the form of a pressure variable electrical resistor, said resistor being coupled in an electrical circuit including an indicator for indicating seaming force.

6. The apparatus of claim 2 wherein said load sensor is in the form of a pressure variable electrical resistor, said resistor being coupled in an electrical curcuit including an indicator for indicating excessive seaming force.

7. The apparatus of claim 4 wherein said electrical circuit includes a temperature sensor and temperature compensating means.

8. The apparatus of claim 4 wherein there are two of said load sensors spaced along said cam face, and said electrical circuit includes selector means for selecting the sensor to be indicated.

9. The apparatus of claim 4 wherein there are plural seaming stations each having a second operation seaming cam, and said electrical circuit includes selector means for selecting the station to be indicated.

* * * * *